US006012306A

United States Patent [19]

Raes

[11] Patent Number: 6,012,306

[45] Date of Patent: Jan. 11, 2000

[54] COMBINED LAUNDRY WASHING AND DRYING MACHINE

[76] Inventor: Gerard Raes, 25 Campbell Street, Sarnia, Canada, N7T 2H2

[21] Appl. No.: 09/024,161

[22] Filed: Feb. 17, 1998

[51] Int. Cl.[7] ..... D06F 13/04; D06F 25/00

[52] U.S. Cl. ..... 68/19.2; 68/20; 68/24; 68/25; 68/122

[58] Field of Search ..... 68/19.1, 19.2, 68/20, 21, 24, 25, 120, 122

[56] References Cited

U.S. PATENT DOCUMENTS

| | | | |
|---|---|---|---|
| 2,500,368 | 3/1950 | Lund | 68/122 X |
| 2,533,888 | 12/1950 | Kahn | 68/19.2 X |
| 2,555,268 | 5/1951 | Chamberlin | 68/20 |
| 2,782,622 | 2/1957 | Candor | 68/25 |
| 2,821,075 | 1/1958 | Keedy | 68/122 X |
| 3,302,433 | 2/1967 | Nallinger | 68/25 X |
| 4,149,393 | 4/1979 | Uhlyarik | 68/122 X |
| 5,058,401 | 10/1991 | Nakamura et al. | 68/19.2 |
| 5,074,131 | 12/1991 | Hirose et al. | 68/19.2 |
| 5,111,673 | 5/1992 | Kadoya et al. | 68/25 X |
| 5,176,012 | 1/1993 | Oh et al. | 68/21 |
| 5,327,603 | 7/1994 | Roh et al. | 68/25 X |

FOREIGN PATENT DOCUMENTS

| | | | |
|---|---|---|---|
| 1016540 | 11/1952 | France | 68/25 |
| 853 434 | 10/1952 | Germany | 68/25 |
| 2-241 490 | 9/1990 | Japan | 68/24 |
| 4-15089 | 1/1992 | Japan | 68/25 |
| 913485 | 12/1962 | United Kingdom | 68/25 |
| WO 89/12711 | 12/1989 | WIPO | 68/25 |

*Primary Examiner*—Philip R. Coe
*Attorney, Agent, or Firm*—Bereskin & Parr

[57] ABSTRACT

A combined laundry washing/drying machine wherein the washing and drying means are mounted within a pivoting subassembly. In the washing mode the laundry is washed within a basket oriented vertically. In the drying mode, the pivoting subassembly is moved so that the laundry is tumbled in the basket as it spins on a horizontal axis. The washing mode further employs a perforated washing plate which moves in a reciprocating vertical motion to provide the cleaning action.

20 Claims, 5 Drawing Sheets

COMBINED LAUNDRY WASHING AND DRYING MACHINE

FIELD OF THE INVENTION

This invention relates to appliances for washing and drying and more particularly relates to a combined laundry washing and drying machine.

BACKGROUND OF THE INVENTION

Conventionally, domestic laundry washing and drying machines have been separate units. The user first places laundry in a washing machine, in which the laundry is washed, rinsed and then spun to remove most of the water. Once it has been washed etc., the wet laundry is then transferred to a laundry drying machine. This is inconvenient in many respects. Firstly, two separate machines have to be provided, both of which are relatively bulky. The cost of two machines is quite high and one can note that many of the basic control elements, e.g. the cabinet, motor, clutches, tub and control electronics are duplicated. While having two machines can theoretically enable a higher throughput, as both machines can be run simultaneously, this is difficult to achieve in practice and requires close monitoring of the machines to ensure prompt removal of the laundry or transfer, when each machine finishes its cycle. Practically, for most domestic use, the throughput available with a single combined machine would be sufficient.

A review of the prior art shows that numerous attempts have been made in the past to provide a combined washer and dryer, but to applicant's knowledge all of these have been unsuccessful. While some designer's have appreciated that it is desirable to provide a tub or basket having an axis which can be tilted between a vertical position for washing and a horizontal position for drying, they have generally failed to recognize that the requirements for this drum or basket are quite different for the two actions of washing and drying. Thus, in conventional, separate washing and drying machines, the basket for washing is of relatively small diameter and includes a central agitator that oscillates about a vertical axis, to wash the laundry in the machine. For drying, a drum having a relatively large diameter rotates about a horizontal axis, to create a tumbling action to promote a flow of heated air through the laundry, to dry the laundry. A drum for drying typically is totally unobstructed in the middle and includes a small number of baffles around the periphery to engage the laundry and cause the tumbling action. Thus, a tub configured for providing a washing action is not suitable, even if mounted for rotation about a horizontal axis for drying the laundry. Similarly, a tub or drum configured for a drying action, is wholly unsuited for providing the agitation for washing laundry, whatever the orientation of the drum.

In the foreign patent literature the following references, all dating from approximately the same period, show early examples of attempts at providing a dual function machine: German Patent Specification 853,434; French Patent 1,016,540; and British Published Specification 913,485.

The French and German proposals both appear to teach a proposal in which a drum or the like can be tilted between two different positions, with its axis either horizontal or vertical to provide the two different functions of washing and drying. A different approach is taken in the British specification, which provides a cylinder for washing, and proposes moving the cylinder with the laundry in it from the washing machine to an extraction machine, without the provision of any drying step.

An early proposal in the U.S. art is U.S. Pat. No. 2,782,622. Here, the drum is only tilted through a small angle, and again a single drum of fixed configuration is intended to provide both the washing and drying actions.

A so-called washing, dehydrating and drying machine is disclosed in U.S. Pat. No. 5,058,401. The apparatus here is extremely complicated, and somewhat unusually, provides a spherical container for the laundry, comprising two hemispherical members molded from resin. The patent teaches three separate steps, namely: washing with rotation about a horizontal axis; spinning about a vertical axis; and drying by rotation about the horizontal axis. U.S. Pat. No. 5,074,131 describes a combined washer and dryer that rotates a tub to approximately 75% for the vertical to initiate the drying mode. This invention utilizes a so-called pulsator to wash the laundry. A somewhat similar proposal can be found in U.S. Pat. No. 5,111,673 which also utilizes a pulsator. In both of these proposals, the pulsator could be characterized as truncated agitators from conventional washing machines which are intended to provide sufficient agitation, while leaving the drum or basket largely unobstructed, so that a tumbling action for drying can be provided. It is believed that such a compromise will impair both the washing and drying actions. Thus, the agitator will probably be insufficient to provide a good washing action, while at the same time it will still be present to interfere with the tumbling action for drying.

Accordingly, what the present inventor has realized is that, in order to provide a combined washing and drying machine, it is necessary to provide some mechanism within the tub or basket, which will enable an efficient washing action to be provided, while at the same time leaving the basket unobstructed for tumbling action during drying. The introduction of a perforated washing plate meets these requirements. By forcing water through the laundry the plate provides a more effective cleaning action than the agitators or pulsators in the prior art. Moreover, the present inventor has realized that it is also desirable to be able to adjust the effective size of the basket, to accommodate different size loads. This becomes particularly important where the basket is large enough, i.e. has a relatively large diameter in volume, so as to be suitable for drying.

SUMMARY OF THE INVENTION

In accordance with the present invention, there is provided a machine for washing and drying laundry, the machine comprising a cabinet, a pivotally mounted subassembly within the cabinet which moves between a washing and a drying position, an activation apparatus for pivoting the subassembly between the washing and drying positions, a tub within the subassembly, a perforated basket within the tub, a washer plate within the perforated basket, an apparatus for moving the washer plate within the basket and an apparatus within the cabinet or subassembly for drying the laundry. The apparatus for moving the washer plate within the basket can comprise a continuously helically grooved drive screw, a pin engaging the helically grooved screw, an apparatus for rotating the washer drive pin so that it follows the path of the continuous helical groove in the drive screw and a washer shaft connecting the washer plate to the drive screw so that rotation of the washer drive pin causes the washer plate to reciprocate within the basket.

BRIEF DESCRIPTION OF THE DRAWINGS

For a better understanding of the present invention, and to show more clearly how it may be carried into effect, reference will now be made, by way of example, to the accompanying drawings which show a preferred embodiment of the present invention and in which.

DETAILED DESCRIPTION OF THE INVENTION

Figure 1:
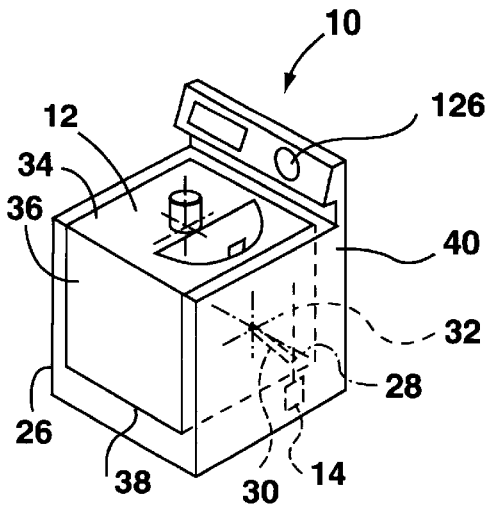
FIG. 1 is a perspective view of the apparatus of the present invention showing it in the laundry washing configuration.
Figure 3:
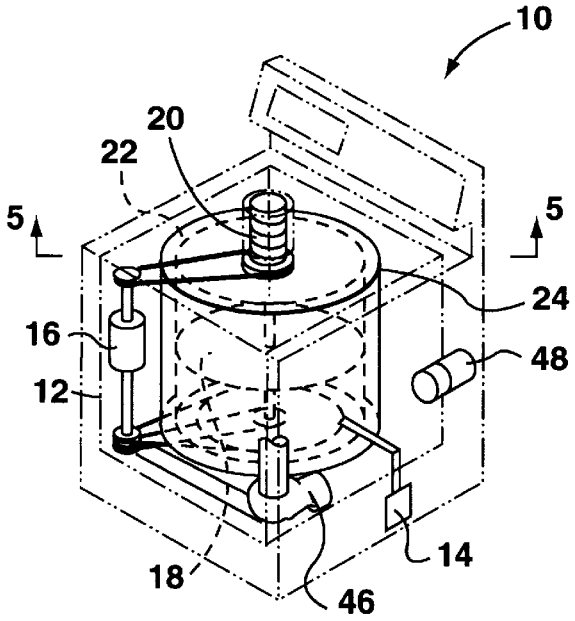
FIG. 3 is a perspective view of the apparatus similar to FIG. 1, and showing internal details.

Referring first to FIGS. 1 and 3, both of a perspective view of the preferred embodiment of the apparatus of the present invention, which provides a combined washer and dryer, shown in the laundry washing configuration is generally indicated by the numeral 10. The principal components of the apparatus consist of a pivotally mounted subassembly 12, a motor 14 for pivoting the subassembly 12, a main drive motor 16, a perforated washer plate 18, a washer plate drive screw 20, a perforated basket 22 and a tub 24.

Figure 2:
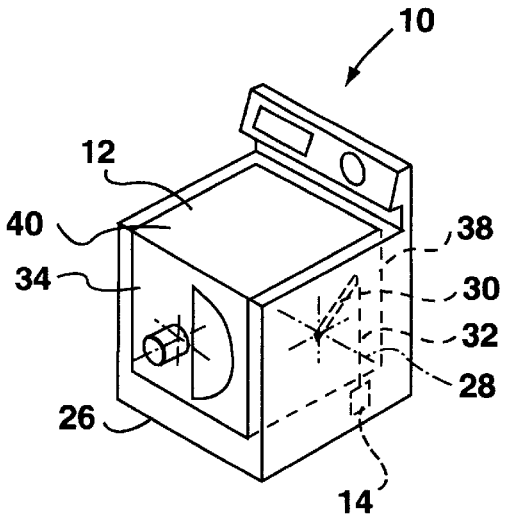
FIG. 2 is a perspective view of the apparatus of the present invention showing it in the laundry drying configuration.

As shown in FIGS. 1 and 2, the subassembly 12 is typically mounted within a cabinet 26 about an axis 28. The cabinet 26 can be largely conventional and can be for example, formed from sheet steel in known manner with the dimensions of a conventional washing machine. The motor 14 is mounted in the base of the cabinet 26, and outside of the subassembly 12. A pivot arm 30 is attached to the subassembly 12 and extends perpendicularly from the axis 28. A rotation screw 32 is attached at one end to the motor 14, and at the other end engages a threaded collar or nut, attached to a free end of the arm 30. Hence, actuation of the motor 14 causes rotation of the rotation screw 32 which in turn drives the collar and free end under the pivot arm 30 towards or away from the motor 14. It will be appreciated that the motor 14 will also be mounted for a small amount of pivotal movement about an axis parallel to the axis 28, to accommodate motion of the pivot arm 30, and the threaded collar or nut (not shown) would be similarly pivotally mounted to the end of the pivot arm 30.

The subassembly 12, as shown in FIG. 1, has a top or access surface 34, a front surface 36, a bottom surface 38 and a rear surface 40. In the washing position of FIG. 1, the front surface 36 is at the front and the top surface 34 is at the top of the apparatus. To pivot to the drying position shown in FIG. 2, the bottom surface 38 and rear surface 40 must be such as to clear fixed components within the cabinet 26. In the drying position of FIG. 2, the top surface 34 is then to the front of the apparatus, and the rear surface 40 is then brought to the top of the apparatus as a whole.

Figure 4:
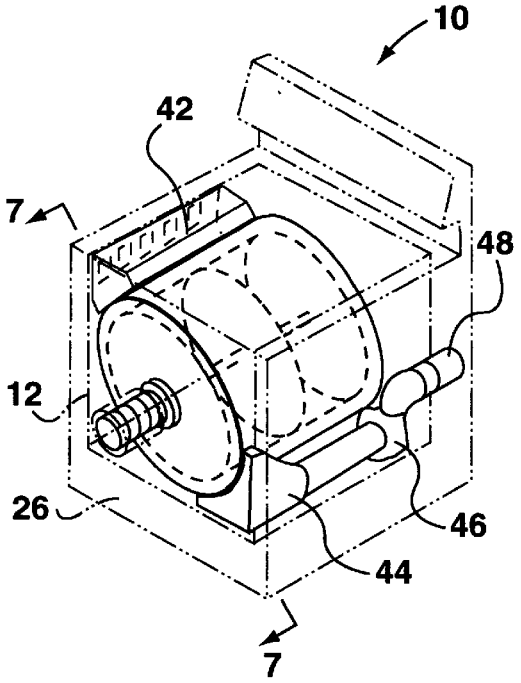
FIG. 4 is a perspective view of the apparatus similar to FIG. 2, and showing internal details.

Referring now to FIG. 4 a perspective view of the preferred embodiment of the apparatus is shown in the laundry drying configuration. An electric heater 42 is mounted to an interior wall of the subassembly 12. Located diagonally opposite the electric heater 42 and within the subassembly 12 are the dryer exhaust tube 44 and the dryer fan 46. A dryer exhaust outlet 48 is mounted within the cabinet 26 and provides an exit for the exhaust air. The dryer exhaust outlet 48 becomes aligned with outlet from the fan 46, when the subassembly 12 is in the drying position of FIGS. 2 and 4. If required a mechanism can be provided to retract the outlet 48 when pivoting the subassembly 12 and/or when the subassembly 12 is in the washing position, to prevent interference with the subassembly 12.

Figure 5:
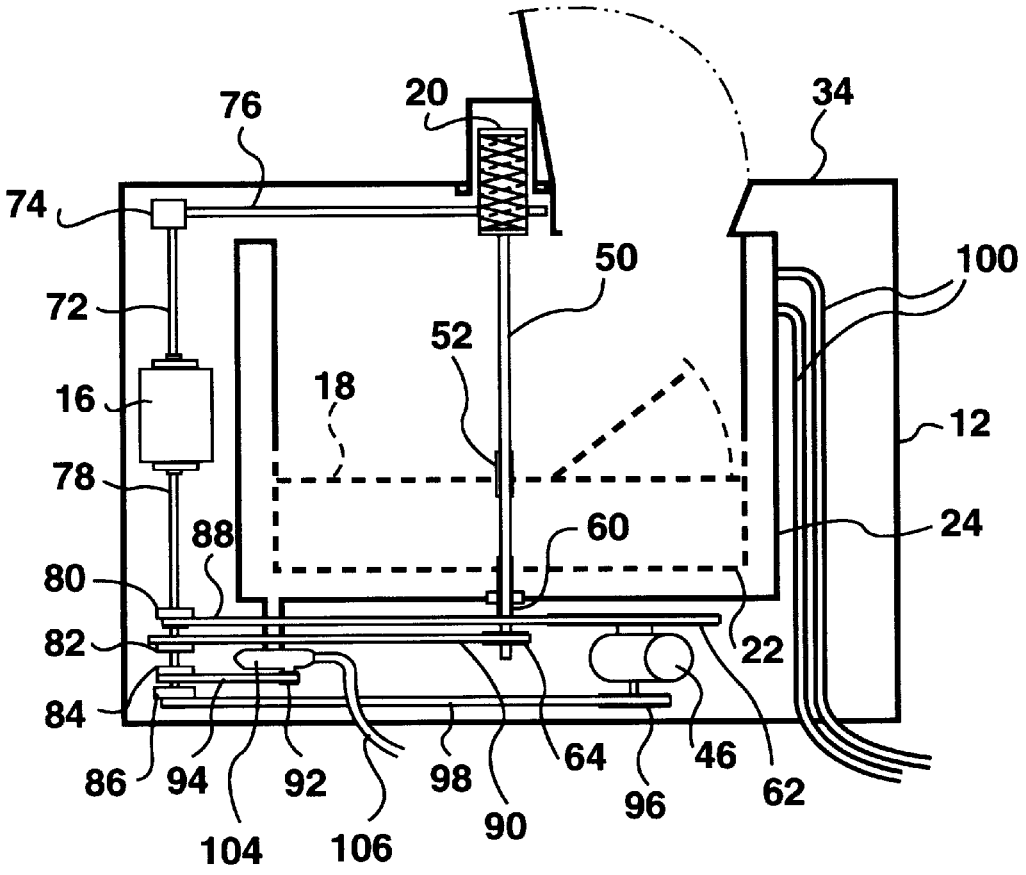
FIG. 5 is a sectional view of a the present invention along line 5—5 of FIG. 3, showing it in the laundry washing configuration.

Referring now to FIG. 5, FIG. 5 is a sectional view of the preferred embodiment of the present invention in the laundry washing configuration. The tub 24 contains the perforated basket 22, and they are both cylindrical in shape. A washer plate shaft 50 extends through the central region of the tub 24 and the perforated basket 22. The perforated washer plate 18 is adjustably attached to the washer plate shaft 50 by means of a washer plate adjustment collar 52, so that the washer plate can be secured at different positions along the washer plate shaft 50. Mated to one end of the washer plate shaft 50 is the washer plate drive screw 20.

The basket 22 is rotatably mounted within the tub 24. At the lower end of the basket 22, as shown in FIG. 5, a shaft sleeve 60 extends from the basket 22 through the wall of the tub 24, with a suitable bearing and seal being provided between them. The shaft sleeve 60 has mounted on its lower end a relatively large dryer drive pulley 62 and a smaller spin dry drive pulley 64. The washer plate shaft 50 extends downwardly through the shaft sleeve 60, and again a suitable bearing and seal arrangement would be provided.

Figure 6:
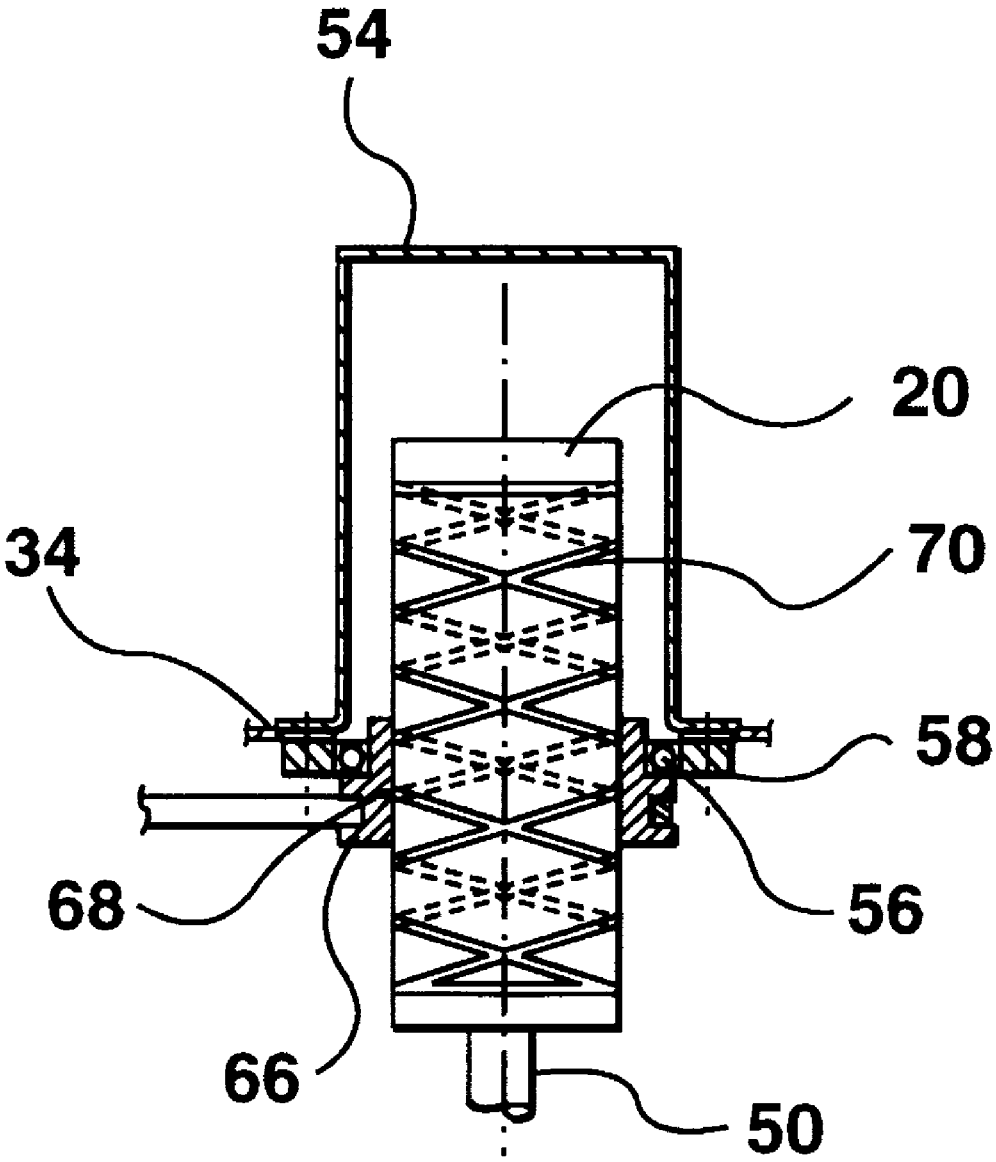
FIG. 6 is a partial sectional view of a washer drive screw and associated components.

Referring now to FIG. 6, FIG. 6 is a partial view of the washer drive screw 20 and associated components. The washer plate drive screw 20 extends from the top surface 34 and is enclosed by a screw cover 54. Enclosing the washer plate drive screw 20 is a washer drive pulley 66, with the drive screw 20 free to slide axially and rotatable within the drive pulley 66. A washer drive screw bearing 56 is provided between the drive pulley 66 and a washer drive screw retainer 58. The drive screw retainer 58 serves to mount the pulley 66 in the top surface 34. A washer drive pin 68 is carried by the pulley 66 and engages a continuous helical groove 70 in the drive screw 20. The arrangement is such that the pin 68 continuously travels up and down the drive screw 20. As the pin 68 is carried by the pulley 66, the drive screw 20, shaft 50 and attached perforated washer plate 18 are forced to oscillate up and down as viewed in FIGS. 5 and 6.

As shown in FIGS. 5 and 6, a washer drive shaft 72 extends from one end of the main drive motor 16. Mounted on washer drive shaft 72 is a washer drive screw clutch 74. The washer drive screw clutch 74 controls drive to a first washer drive pulley, which in turn is connected by a washer drive screw belt 76 to the washer drive pulley 66, as a second washer drive pulley, for the washer drive screw 20. Extending from the end of the main drive motor 16 opposite the washer drive shaft 72 is a second drive shaft 78. Attached to drive shaft 78 are a dryer clutch 80, a spin dry clutch 82, a water pump clutch 84, and a dryer fan clutch 86; each of these clutches controls a drive connection to a respective first drive pulley, similarly to the drive screw clutch 74. The pulley for the dryer clutch 80 is connected to the dryer drive pulley 62 by dryer drive belt 88. The pulley for the spin dry clutch 82 is connected to the spin dry drive pulley 64 by spin dry drive belt 90, and the pulley for the water pump clutch 84 is connected to a water pump drive pulley 92 by water pump drive belt 94. The pulley for the dryer fan clutch 86 is connected to a dryer fan pulley 96 by dryer fan drive belt 98.

As also shown in FIG. 5, two water supply hoses 100, one for hot water, and the other for cold water, supply water to the tub 24, in known manner. A water exit or drain 102 connects the tub 24 to a water pump 104, driven by the water pump drive pulley 92. The water pump 104 is connected on the outflow side to water pump hose 106. The hoses 100, 106 would be sufficiently long and flexible to accommodate pivoting of the subassembly 12 between the washing and drying positions.

Figure 7:
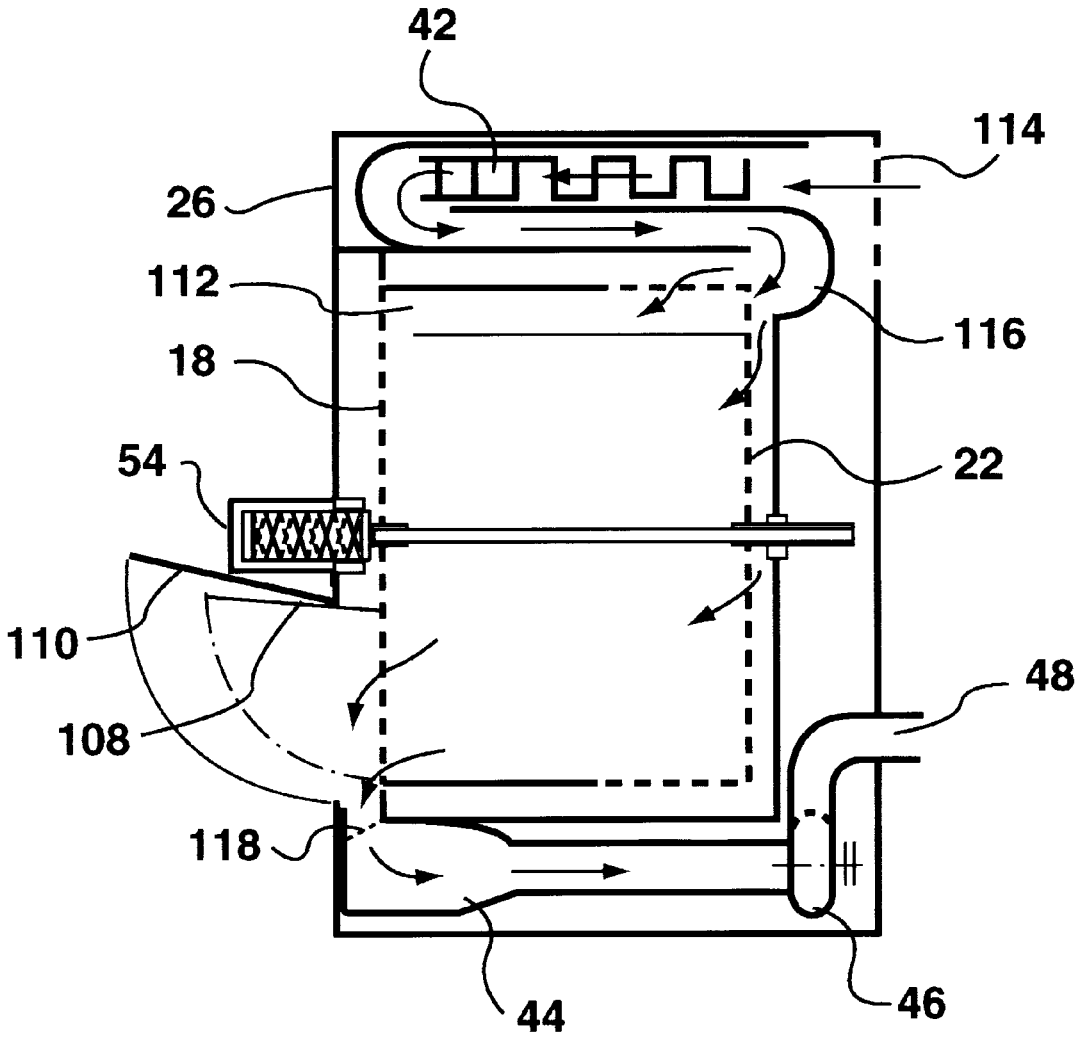
FIG. 7 is a sectional view of the present invention along line 7—7 of FIG. 4, showing it in the laundry drying configuration.

Referring now to FIG. 7, a sectional view of the pivotally mounted subassembly 12 is shown in the laundry drying configuration. The perforated washer plate 18 contains a hinged, self locking, washer plate lid 108. In the top surface 34 of pivoting subassembly 12 is a washer/dryer lid 110. Mounted equally spaced within the circumference of the basket 22 are three dryer baffles 112. As mentioned, the electric heater 42 is mounted to an interior wall of the pivoting subassembly 12. A drying air inlet 114 allows air to enter cabinet 26. A water baffle 116 allows heated air to enter the perforated basket 22. A lint filter 118 is mounted at the entrance of the dryer exhaust tube 44.

Figure 8:
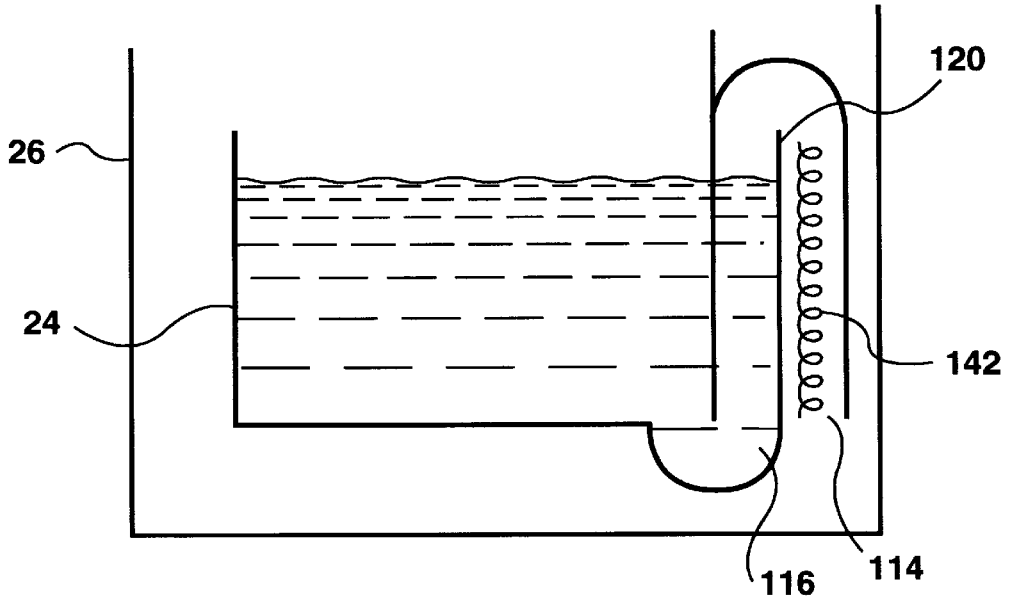
FIG. 8 is a perspective view of the apparatus of the present invention illustrating the configuration of a water baffle.

Referring now to FIG. 8, a perspective view of the apparatus of the present invention illustrates the function of the water baffle 116. In the washing position, the water in tub 24 fills water baffle 116. In drying mode water baffle 116 connects drying air inlet 114 to the interior of tub 24. The baffle 116 is generally U-shaped and includes a barrier 120, that is sufficiently high, as viewed in FIG. 8, to prevent spillage of water out through the drying air inlet 114.

Figure 9:
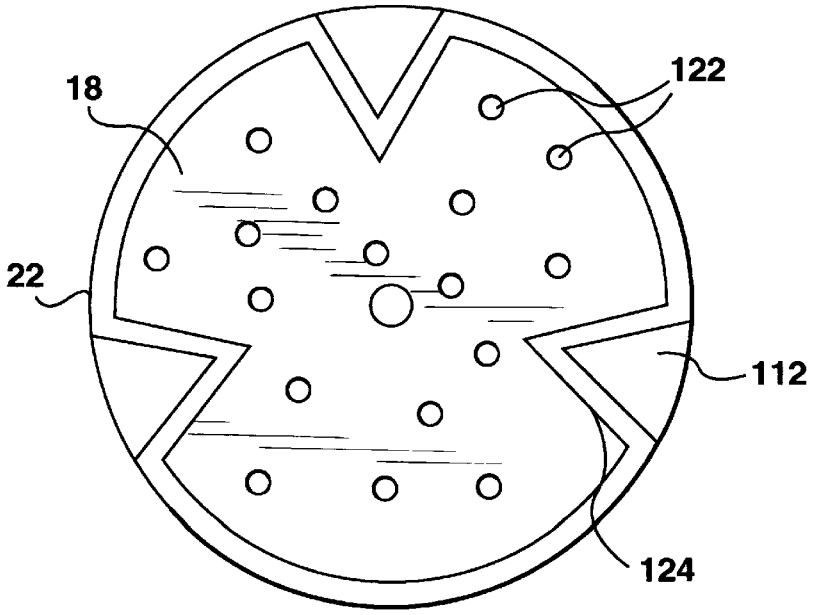
FIG. 9 is a top view of the washer plate.

Referring now to FIG. 9, this shows a top view of the perforated washer plate 18, which contains a number of perforations 122. The positioning of the perforations 122 may be irregular as illustrated or they may form a more regular geometric pattern in the washer plate 18. Notches 124 in the washer plate 18 accommodate dryer baffles 112. More particularly, the notches and dryer baffles 112 act like cooperating splines, to permit the washer plate 18 to oscillate axially but prevent relative rotation between them.

The cabinet 26 can include a control panel in known manner, and here this includes an electric timer 126 (FIG. 1), for controlling the washing and drying cycles.

In use the combined laundry washing and drying machine operates as follows: with the apparatus initially in the washing position of FIGS. 1, 3 and 5, the user opens the washer/dryer lid 110 exposing the washer plate lid 108 which is next opened. Soap and laundry to be cleaned are then deposited in the basket 22. The user then adjusts the height of the perforated washer plate 18 using the washer plate adjustment collar 52 based upon the level of laundry in the basket 22. The washer plate lid 108 and the washer/dryer lid 110 are then closed and the combined washer/dryer 10 is started by setting the electric timer 126. The electric timer then opens the water supply valves (not shown) for the water supply hoses 100 until the tub 24 is filled to the appropriate level, in a known manner water level sensors can be provided. The electric timer 126 then closes the water supply valves (not shown) and starts main drove motor 16, with the various drive clutches disengaged. The washer drive screw clutch 74 is then engaged which results in the washer drive screw belt 76 rotating the washer drive pulley 66. The pulley 66 in turn rotates washer drive screw bearing 56. As the pulley 66 rotates, washer drive pin 68 traces a helical path in the continuous groove 70 of washer plate drive screw 20, causing the washer plate shaft 50 to move in a reciprocating motion. The shaft 50 is mounted in the washer drive shaft sleeve 42, so that it can reciprocate. The washer plate shaft 50 is prevented from rotating by the dryer baffles 112 which are retained in notches 124 of the washer plate 18 (FIG. 9). As the washer plate shaft 50 moves downward toward the laundry, the perforated washer plate 18 forces water through the laundry. As the washer plate shaft 50 moves upward away from the laundry, the perforated washer plate 18 provides a slight suction action which allows the water to circulate among the laundry. At the end of the washing cycle as determined by the electric timer 126, the washer drive screw clutch 74 is disengaged and the main drive motor 16 stops spinning washer drive shaft 72. The water pump clutch 84 is then engaged which rotates the water pump drive belt 94 which in turn rotates the water pump drive pulley 92, and drives the water pump 104 which then pumps the water out of the tub 24 through the water exit 102 to the water pump hose 106 which leads to an external drain.

With the pump 104 still running, the spin dry clutch 82 is then engaged and the spin dry drive belt 90 begins to rotate the spin drive pulley 64. As the spin dry pulley 64 rotates, it rotates the shaft sleeve 60 which being fixably attached to the basket 22 causes the basket 22 to rotate. The spin dry pulley 64 is of a diameter such that the basket 22 rotates at a speed sufficient to effectively remove the water from the laundry by centrifugal force. The water exits the basket 22 through perforations in the side of the basket 22 and falls to the base of the tub 24. The water pump 104 then ensures this water is discharged to the water pump hose 106. After the laundry has been spun for a period of time sufficient to remove a significant amount of water, the spin dry clutch 82 and the water pump clutch 84 are disengaged. If desired, this cycle can be repeated with fresh water, to effect a rinse action, as is known.

After a time period sufficient to allow the basket 22 to stop rotating, the user then opens the washer/dryer lid 110, and the washer plate lid 108 and moves the washer plate 18 (along the washer plate shaft 50) to the top of the basket 22, using the washer plate adjustment collar 52, thus creating a large, free area in the basket 22 for the laundry to tumble dry.

The user then sets the electric timer 126 to drying mode which causes the motor 14 to engage. As the motor 14 rotates the rotation screw 32, the pivot arm 30 is moved causing the pivotally mounted subassembly 12 to pivot toward a horizontal or drying position. Once the subassembly 12 is in the horizontal or drying position, the motor 14 is turned off. Here, it is noted that it is preferable to provide a mechanism to lock the subassembly 12 in the washing and drying positions, so that loads resulting from washing, spinning and drying actions are not transferred through the pivot arm 30 and rotation screw 32. The main drive motor 16 is then activated and the dryer clutch 80 is engaged. The dryer clutch 80 rotates dryer drive belt 88 which in turn rotates dryer drive pulley 62. As dryer drive pulley 62 rotates it causes the basket 22 to rotate, thus tumble drying the laundry. Simultaneously, the clutch 86 is activated to provide drive to the dryer fan 46, which draws air through the tub 24 and exhausts it through the dryer exhaust outlet 48. Within basket 22 are three conventional dryer baffles 112. Electric heater 42 is activated to heat incoming ambient air to dry the laundry. Air enters the cabinet 26 through a drying air inlet 114 due to the suction of dryer fan 46. The air is heated by electric heater 42 and enters the tub 24 by way of the water baffle 116. The dryer fan 46 extracts the moisture laden air from the rotating basket 22 through the lint filter 118 into the dryer exhaust tube 44 and forces it out the dryer exhaust outlet 48. Once the drying cycle is complete, the electric heater 42 and dryer fan 46 are shut off. The dryer clutch 80 is then disengaged and the main drive motor 16 stopped. The motor 14 is then engaged to retract the rotation screw 32, thus returning the pivotally mounted subassembly 12 to a vertical position. Once the subassembly 12 is in a vertical position, the motor 14 is shut off. The user may then remove the dry laundry by first opening washer/dryer lid 110 and then washer plate lid 108. Alternatively, the control circuitry can be configured to leave the subassembly 12 in the drying position, once drying is finished, as many users may find it more convenient to unload the machine in this position.

Although the preferred embodiment makes use of one dryer fan 44, improved air flow may be achieved by mounting a dryer fan near the drying air inlet 114 to push air through the perforated basket 22.

As will be apparent to those skilled in the art, various modifications and adaptations of the method and system described above are possible without departing from the present invention, the scope of which is defined in the appended claims.

I claim:

1. A machine for washing and drying laundry comprising:

a cabinet;

a subassembly, pivotally mounted in said cabinet for movement between a washing position and a drying position;

activation means, for pivoting said subassembly between the washing and drying positions, said activation means being mounted in said cabinet and connected to said subassembly;

a tub mounted in said subassembly;

a perforated basket mounted in said tub for containing the laundry;

a washer plate provided within said perforated basket;

drive means mounted on said subassembly for continuously vertically reciprocally moving said washer plate within said perforated basket while washing said laundry, and fully retracting said washer plate during drying of said laundry, and for rotating said perforated basket and drying means mounted on one of said cabinet and the subassembly, for providing air for drying said laundry.

2. A machine for washing and drying laundry as claimed in claim 1 in which said activation means comprises:

a motor mounted within said cabinet;

a rotation screw connected at one end to said motor; and a pivot arm secured at one end to said pivoting subassembly, wherein said rotation screw rotatably engages the other end of said pivot arm, whereby rotation of the rotation screw displaces said one end of the pivot arm to pivot the subassembly.

3. A machine for washing and drying laundry as claimed in claim 1 further comprising;

a drive motor mounted in said subassembly;

a drive shaft connected to said drive motor;

a plurality of selectable clutches connected to said drive shaft; and a plurality of drive transmission means connected to said selectable clutches for selective transmission of drive from the drive motor, wherein the basket is mounted for rotation in the subassembly and at least one of the transmission means connects the motor to the basket for rotation thereof.

4. A machine as claimed in claim 3, wherein the basket is rotatably mounted in the tub, and the tub is provided with connections for supply and discharge of water.

5. A machine for washing and drying laundry as claimed in claim 4 in which said plurality of selectable clutches comprises:

a washer drive screw clutch connected to said drive shaft;

a dryer clutch connected to said drive shaft;

a spin dry clutch connected to said drive shaft;

a dryer fan clutch connected to said drive shaft;

a water pump clutch connected to said drive shaft and wherein the machine includes a water pump connected to the water pump clutch, for drive transmission, and connected to the tub for pumping water out of the tub.

6. A machine for washing and drying laundry as claimed in claim 5 in which said plurality of transmission means comprises:

a first washer drive pulley mounted on said drive means, a second washer drive pulley mounted on the washer drive screw clutch, and a washer drive belt connecting the washer drive pulleys;

a first dryer drive pulley secured to the dryer clutch, a second dryer drive pulley secured to the basket and a dryer drive belt connecting the first and second dryer drive pulleys;

a first spin drive pulley secured to the spin dry clutch, a second spin drive pulley secured to the basket and a spin dry drive belt connecting the first and second the spin dry drive pulleys;

a first dryer fan pulley secured to the dryer fan clutch, a second dryer fan pulley connected to the dryer fan, and a dryer fan drive belt connecting the first and second dryer fan pulleys; and a first water pump drive pulley secured to the water pump clutch and a second water pump drive pulley connected to the water pump, and a water pump drive belt connecting the first and second water pump drive pulleys.

7. A machine for washing and drying laundry as claimed in claim 6, which includes two drive shafts for the motor, wherein the motor is mounted substantially parallel to the axis of rotation of the basket, wherein the washer drive screw clutch is provided on one drive shaft and the dryer clutch, the dryer fan clutch and the spin dry clutch are provided on the other drive shaft, with the water pump clutch provided on either one of the two drive shafts.

8. A machine for washing and drying laundry as claimed in claim 7, wherein the water pump clutch is provided on the other drive shaft.

9. A machine for washing and drying laundry as claimed in claim 1 in which said drive means comprises:

a continuously helically grooved washer drive screw;

a washer drive pin engaging said grooved washer drive screw;

means for rotating said washer drive pin so that said washer drive pin follows the path of the continuous helical groove in said washer drive screw; and a washer plate shaft connected to the washer drive screw which is mounted in the basket, wherein the plate is mountable on the washer plate shaft, whereby rotation of the washer drive pin causes reciprocation of the washer plate shaft and the plate within the basket.

10. A machine for washing and drying laundry as claimed in claim 9, wherein a shaft sleeve is provided secured to one of the tub and to the perforated basket, wherein the dryer drive pulley and the spin dry drive pulley are mounted on the shaft sleeve, and the shaft sleeve provides a bearing for the washer plate shaft.

11. A machine for washing and drying laundry as claimed in claim 9 in which said washer plate is releasably mounted on said washer plate shaft to permit mounting of the washer plate at different axial locations along the washer plate shaft.

12. A machine for washing and drying laundry as claimed in claim 1 in which said washer plate contains a plurality of perforations.

13. A machine for washing and drying laundry as claimed in claim 12, in which said washer plate contains notches to accommodate dryer baffles, and to prevent relative rotation between the washer plate and the perforated basket.

14. A machine for washing and drying laundry as claimed in claim 1 in which said drying means comprises:

a heater means mounted on one of said cabinet and said subassembly;

a drying air inlet in said tub to allow heated air from said heater to enter said basket containing the laundry;

a dryer exhaust fan for extracting moisture laden air from said basket and thereby drawing heated air into the basket through the drying air inlet;

a dryer exhaust tube connected to said exhaust fan for venting the moisture laden air directed by said exhaust fan; and a dryer exhaust outlet connected to said dryer exhaust tube providing an exit portal outside of the cabinet for discharge of the moisture laden air.

15. A machine for washing and drying laundry as claimed in claim 14 wherein said drying means further comprises a dryer fan mounted adjacent said drying air inlet for forcing air into said drying air inlet.

16. A machine for washing and drying laundry comprising:

a cabinet;

a tub mounted in said cabinet;

a perforated basket mounted in said tub for containing the laundry;

a washer plate provided within said perforated basket;

drive means mounted on said subassembly for continuously vertically reciprocally moving said washer plate within said perforated basket while washing said laundry, and fully retracting said washer plate during drying of said laundry, and for rotating said perforated basket; and drying means mounted on said cabinet, for providing air for drying said laundry.

17. A machine for washing laundry as claimed in claim 16 in which said drive means comprises:

a continuously helically grooved washer drive screw;

a washer drive pin engaging said grooved washer drive screw;

means for rotating said washer drive pin so that said washer drive pin follows the path of the continuous helical groove in said washer drive screw; and a washer plate shaft connected to the washer drive screw which is mounted in the basket, wherein the plate is mountable on the washer plate shaft, whereby rotation of the washer drive pin causes reciprocation of the washer plate shaft and the plate within the basket.

18. A machine for washing laundry as claimed in claim 17 in which said washer plate contains a plurality of perforations.

19. A machine for washing laundry as claimed in claim 18, in which said washer plate contains notches to accommodate baffles, and to prevent relative rotation between the washer plate and the perforated basket.

20. A machine for washing laundry as claimed in claim 19 in which said washer plate is releasably mounted on said washer plate shaft to permit mounting of the washer plate at different axial locations along the washer plate shaft.

* * * * *